US006056853A

United States Patent [19]

Vincent et al.

[11] Patent Number: 6,056,853

[45] Date of Patent: May 2, 2000

[54] PROCESS FOR PEROXIDE BLEACHING OF PULP USING MGO PARTICLES

[75] Inventors: Adam Hayden Vincent, Blackburn; Ian Alexander McLean, Riddells Creek, both of Australia

[73] Assignee: Orica Australia Pty. Ltd., Melbourne, Australia

[21] Appl. No.: 08/981,192

[22] PCT Filed: Jun. 13, 1996

[86] PCT No.: PCT/AU96/00354

§ 371 Date: Feb. 19, 1998

§ 102(e) Date: Feb. 19, 1998

[87] PCT Pub. No.: WO96/41917

PCT Pub. Date: Dec. 27, 1996

[51] Int. Cl.[7] ..... D21C 9/16

[52] U.S. Cl. ..... 162/78; 162/79; 162/89

[58] Field of Search ..... 162/78, 79, 89; 8/111

[56] References Cited

PUBLICATIONS

Abstract: Paperchem No.: AB6608917, May 1995.

*Primary Examiner*—Dean T. Nguyen

*Attorney, Agent, or Firm*—Mathews, Collins, Shepherd, & Gould, P.A.

[57] ABSTRACT

A process for peroxide bleaching of pulp using magnesium oxide as sole alkaline source wherein said pulp is bleached in the presence of hydrogen peroxide for a maximum period of 180 minutes and achievement of a maximum target ISO brightness of 65 in regard to freshly prepared pulp characterized in that said magnesium oxide is utilized as MgO particles having a particle size of 5–500 microns and a particle surface area (PSA) of between 20–60 $m^2/g$. By using such parameters, a peroxide bleaching process may be carried out most efficiently on a commercial scale.

11 Claims, 4 Drawing Sheets

PROCESS FOR PEROXIDE BLEACHING OF PULP USING MGO PARTICLES

FIELD OF THE INVENTION

THIS INVENTION relates to a process for peroxide bleaching of pulp. Pulps which may be bleached in the process of the invention include lignocellulose pulp which may be produced mechanically and chemi-mechanically with yields in the region of greater than 75% which are otherwise known as high yield pulps.

BACKGROUND OF THE INVENTION

In a conventional peroxide bleaching process, sodium hydroxide is used as an alkali source. To achieve a desired brightness with maximum efficiency, auxiliary substances are also used. Such auxiliary substances include sodium silicate, magnesium sulphate and chelating agents inclusive of DTPA (sodium salt of diethylene triamino pentaacetic acid).

Reference may be made to a prior art article by Soteland et al., 1988, TAPPI Proceedings 231–236, which describes a peroxide bleaching process which utilises magnesium oxide as a sole alkaline source. The pulp was pretreated with DTPA and magnesium oxide particles were utilised in a size range of 1.00 mm–0.25 mm or smaller. The magnesium oxide were also used in a concentration of 2–3% based on the dry weight of the pulp. The MgO used in the process was light-burnt MgO and finely crushed. It was found that brightness levels obtained were very close to that which was achieved by conventional bleaching using NaOH. In the bleaching process, the pulp was diluted to form a pulp suspension and the amount of MgO was added to the suspension under vigorous stirring. Hydrogen peroxide was subsequently added to the suspension at a concentration of 3% based on the weight of the pulp. This reference also made the observation that coarse particles are less effective as an alkaline source during peroxide bleaching.

Having regard to the abovementioned reference, an observation was also made in the corresponding patent specification DE3617942 that use of MgO as sole alkaline source considerably simplified the bleaching process since sodium hydroxide as alkaline source and auxiliary chemicals such as sodium silicate could be omitted.

Another advantage of using MgO as sole alkaline source was that only a small amount of waste is produced in the bleaching plant. Thus, for example, in integrated mills which produce magnesium sulphite pulp and peroxide bleached high-yield pulps, the used bleaching liquor is combusted and the MgO may be recovered for re-use.

However, the use of MgO as sole alkaline source in a peroxide bleaching process has not as yet achieved widespread commercial acceptance because although the principle of utilising MgO as sole alkaline source was described in the Soteland at al. references, the means of reducing the principle to practice on a commercial scale has not yet been fully elucidated.

SUMMARY OF THE INVENTION

Surprisingly, it has now been discovered that commercial usage of magnesium oxide as a sole alkaline source in peroxide bleaching of wood pulp may be achieved by employing MgO particles with a particle size of less than 500 micron and more preferably less than 75 micron and having particle surface area (PSA) of between 20–60 $m^2/g$ and more preferably between 30–50 $m^2/g$. By using such parameters, an efficient peroxide bleaching process may be carried out most efficiently on a commercial scale which may be achieved within a maximum bleaching time of 180 minutes and achievement of a maximum target of ISO brightness of 65 in regard to freshly prepared pulp.

Utilizing MgO with parameters outside those stated above will result in a less efficient bleaching process leading to higher usage of chemicals and therefore higher operating costs.

The dosages of MgO that may be utilised in the process of the invention is 0.3–2% based on the weight of the pulp.

The amount of hydrogen peroxide that may be utilised in the process of the invention is from 1–5% based on the weight of the pulp.

To achieve maximum efficiency, the MgO particles are preferably added to the pulp in the form of a powder or slurry prepared in situ.

Preferably the MgO is added to the pulp simultaneously with the peroxide or prior to the addition of the peroxide.

Chelating agents also may be used in the process of the invention and such chelating agents may comprise DTPA, EDTA or HEDTA (hydroxy-ethylene diamine tetracetic acid). Preferably the chelating agent is added to the pulp simultaneously with addition of MgO particles, as well as prior to addition of MgO particles.

Bleaching times of 60–180 minutes may also be utilised by the process of the invention to achieve a target ISO brightness of 55–65.

BRIEF DESCRIPTION OF DRAWINGS

In several preferred embodiments concerning the process of the invention which are discussed hereinafter in relation to Experiments 1 and 2.

DESCRIPTION OF THE PREFERRED EMBODIMENTS

EXPERIMENT 1

EFFECT OF MGO PARTICLE SIZE ON THE BLEACABILITY OF CCS PULP

Introduction

This work was performed to establish a relationship between MgO particle size and alkali performance in the bleaching of CCS (Cold Caustic Soda) wood pulp. Four grades of MgO were trialled, each one identified by its particle size distribution. Each sample of MgO had approximately the same surface area. Particle size and surface area for each of the samples is given in Table 1.

Summary of bleaching work

CCS (chemi-mechanical pulp), pretreated with DTPA to remove metal ions, was retrieved from the washers in the bleach plant at the Boyer mill. An equivalent mass of 20 grams OD of pulp was weighed out and placed in a plastic breaker. DTPA was then added as 0.15% v/w on the pulp and mixed. MgO as 0.4% wow, enough water to give a stock consistency of 12% and peroxide as 1.6% v/w on pulp was added and mixed for 2 minutes. The pulp was wrapped in plastic bags and placed into a constant temperature water bath at 65° C. A 3 gram OD sample was removed from the bath at intervals of 2, 3 and 4 hours. This was then made into a brightness hand sheet using the standard Boyer pulp mill method. These were dried overnight in a constant temperature/humidity room and tested for ISO brightness. This procedure was repeated for all MgO samples as well as with control pulp containing no MgO (sample J)

Results

Figure 1:
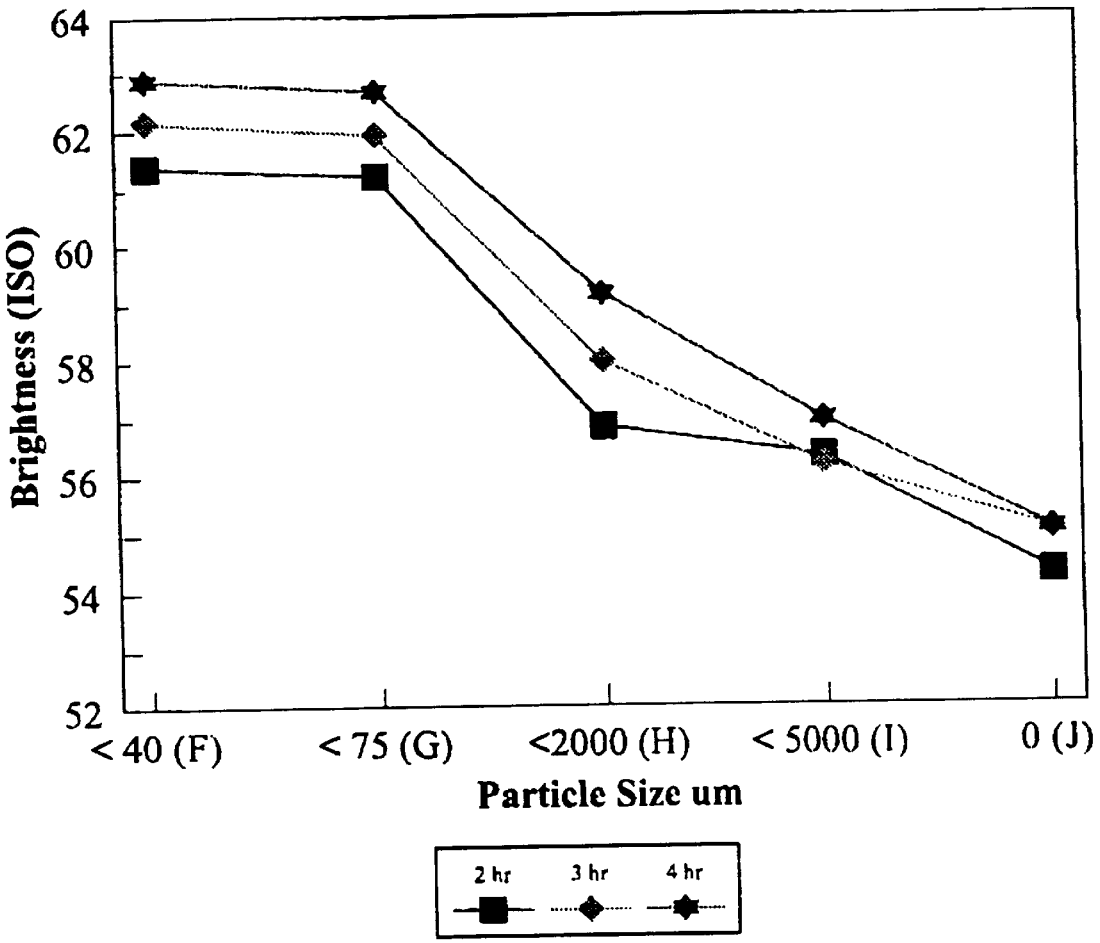
FIG. 1 is a graph showin the effect of particle size on CCS (Cold Caustic Soda) pulp and more specifically showing particle size vs brightness at different times.

The results of this study indicate that particle size is a key parameter for achieving efficient peroxide bleaching of chemic-mechanical pulp. The results shown in Table 2 and FIG. 1 of this study indicate that an MgO particle size of <75$\mu$ (samples G and F, d90=65 and 35 respectively) is required to achieve a target brightness for a given retention time of 2, 3 or 4 hours.

To achieve an equivalent brightness with samples C (d90=1500) or D (d90=3500), the chemical dosages of MgO and $H_2O_2$ would need to be increased.

EXPERIMENT 2

EFFECT OF MGO PARTICLE SURFACE AREA ON THE BLEACHABILITY OF CCS PULP

Introduction

This work was performed to establish a relationship between MgO particle surface area and alkali performance in the bleaching of CCS (Cold Caustic Soda) wood pulp. Five grades of MgO were trialled, each one identifiable by its particle surface area. Each sample of MgO had approximately the same particle size. Particle size and surface area data for each of the samples is given in Table 3.

Summary of bleaching work

CCS (chemi-mechanical) pulp, pre-treated with DTPA to remove metal ions, was retrieved from the washers in the bleach plant at the Boyer mill. For each sample, a mass of 10 g O.D. pulp was placed into a beaker and the approximate mass of chemicals added. The pulp was mixed for 2 minutes in a bench top mixer. The pulp was then wrapped in plastic bags and placed into a constant temperature water bath at 65° C. After two hours retention, the samples were removed from the bath and divided into two. Half the sample was returned to the bath for a further hour of reaction while the other half was made into 5 gram brightness hand sheets. These were dried overnight and then tested for ISO brightness. The work was repeated with samples taken at 2, 3 and 4 hours.

Results

Figure 2:
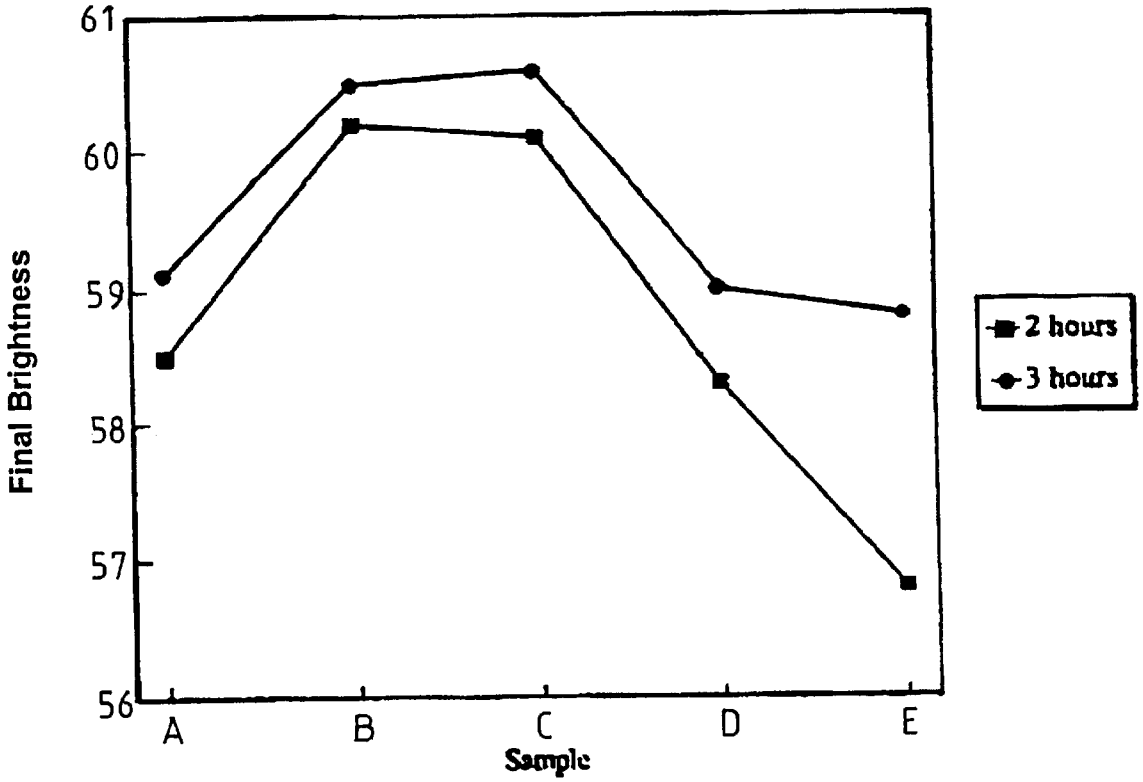
FIG. 2 refers to the results of Experiment 2 whereby various samples are plotted against final brightness.
Figure 3:
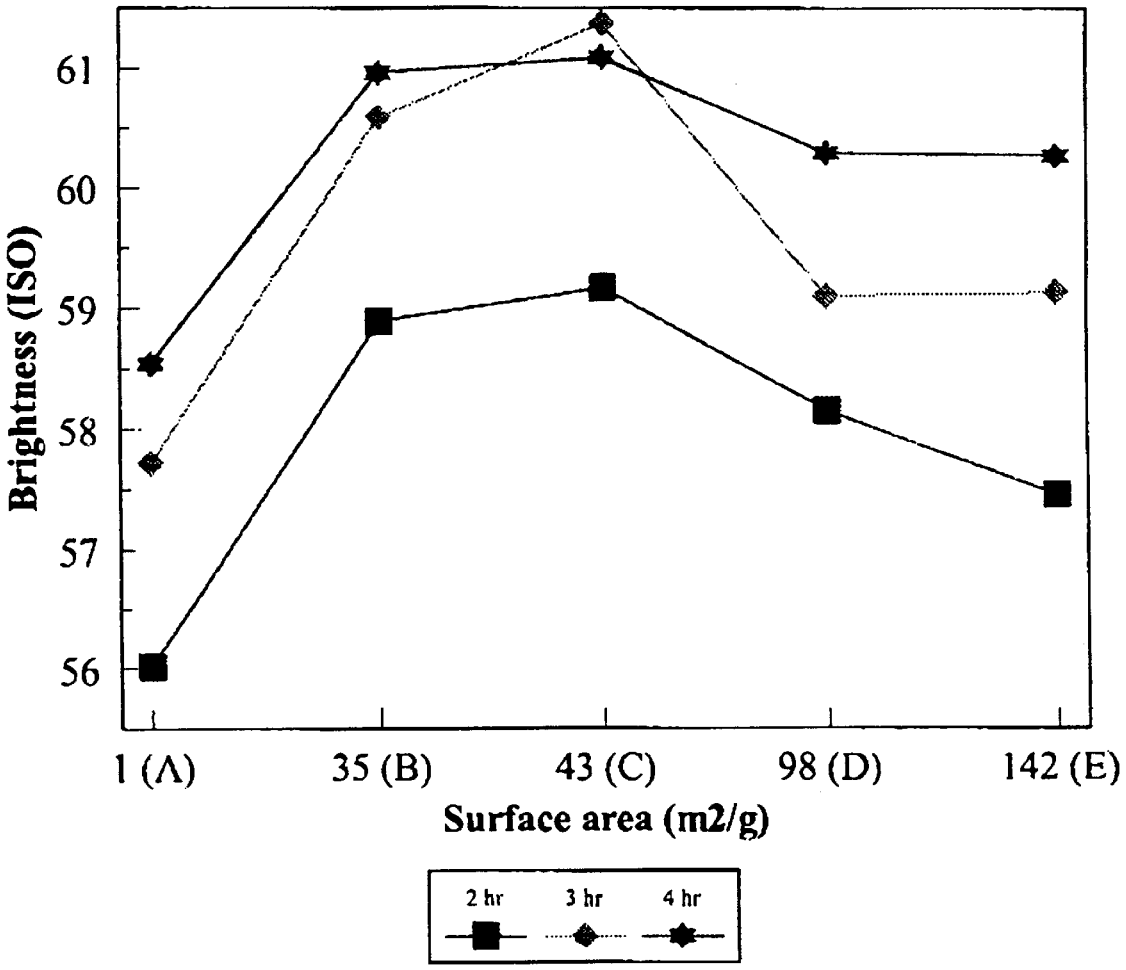
FIG. 3 also refers to the result of Experiment 2 and shows the effect of surface area on CCS pulp and more specifically showing particle size vs brightness at different times.

In the previous study (Experiment 1), we determined that MgO particle size was important for peroxide bleaching efficiency. The results of this study indicate that particle surface area is also a key parameter for achieving maximum brightness for a given chemical dose. The results from these two independent studies (Tables 4 and 5, FIGS. 2 and 3) indicate that a surface area in the range 30–50 $m^2/g$ (samples B and C) is required to achieve maximum brightness for a given retention time and chemical dose. Surprisingly, when the surface area is either decreased or increased, the peroxide bleaching efficiency is reduced as indicated in FIGS. 2 and 3 by the bell shaped curves with brightness plateaus between samples B and C. To achieve an equivalent brightness to samples B and C with samples A, D or E, the chemical charges of $H_2O$ and MgO would need to be increased.

Figure 4:
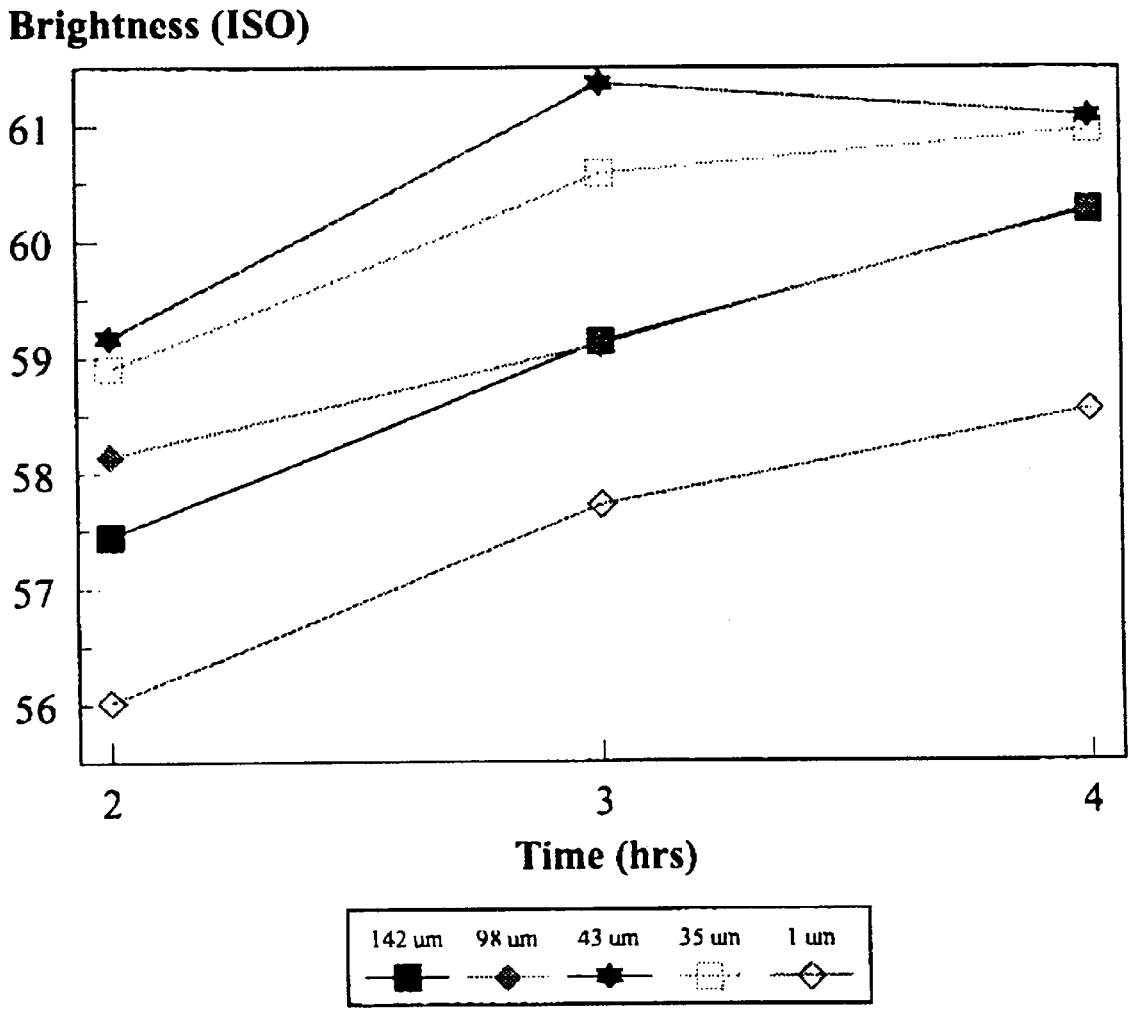
FIG. 4 shows the results of FIG. 3 when plotted against time.

The results in FIG. 3, when plotted against time (FIG. 4), appear to indicate that a similar brightness will be achieved with four of the five samples when the bleaching time is extended indefinitely. However, indefinite bleaching time is not a commercial reality and there is a clear benefit, based on these results, in employing MgO particles with a specific size and surface area. In fact, if MgO particles, with parameters outside those stated in this document are used, then the target brightness may not be achieved without increasing chemical dose rates.

TABLE 1

| Sample | Particle size d90 micron | Surface area $m^2/g$ |
|---|---|---|
| F | 35 | 38 |
| G | 65 | 35 |
| H | 1500 | 30 |
| I | 3500 | 30 |

TABLE 2

| Sample | Surface Area $m^2/g$ | Brightness 2 hr | 3 hr | 4 hr |
|---|---|---|---|---|
| F | <40 | 61.39 | 62.17 | 62.88 |
| G | <75 | 61.22 | 61.94 | 62.69 |
| H | <2000 | 56.85 | 57.98 | 59.17 |
| I | <5000 | 56.32 | 56.19 | 56.97 |
| J | 0 | 54.3 | 55.03 | 55.04 |

TABLE 3

| Sample | Particle size d90 micron | Surface area $m^2/g$ |
|---|---|---|
| A | 14 | 1 |
| B | 10 | 35 |
| C | 10 | 43 |
| D | 15 (d90 = 70) | 96 |
| E | 11 | 142 |

TABLE 4

| Sample | Surface Area $m^2/g$ | Brightness 2 hr | 3 hr |
|---|---|---|---|
| A | 1 | 58.5 | 59.1 |
| B | 35 | 60.2 | 60.5 |
| C | 43 | 60.1 | 60.6 |
| D | 98 | 58.3 | 59.0 |
| E | 142 | 56.8 | 58.8 |

TABLE 5

| Sample | Surface Area $m^2/g$ | Brightness 2 hr | 3 hr | 4 hr |
|---|---|---|---|---|
| A | 1 | 56.02 | 57.75 | 58.54 |
| B | 35 | 58.89 | 60.58 | 60.96 |
| C | 43 | 59.17 | 31.37 | 61.09 |
| D | 98 | 58.15 | 59.1 | 60.29 |
| E | 142 | 57.45 | 59.13 | 60.27 |

LEGENDS

TABLE 2

| Bleaching conditions |
|---|
| MgO% w/w on oven dry pulp = 0.4% |
| $H_2O_2$ - 1.6% |
| DTPA = 0.15% |
| Temperature = 65° C. |
| Initial brightness 47.1 |

TABLE 4

| Bleaching conditions |
|---|
| MgO% w/w on oven dry pulp = 0.3% |
| $H_2O_2$ = 1.8% |
| DTPA = 0.1% |
| Temperature = 65° C. |
| Initial brightness 43.5 |

TABLE 5

| Bleaching conditions |
|---|
| MgO% w/w on oven dry pulp = 0.4% |
| $H_2O_2$ = 1.6% |
| DTPA = 0.15% |
| Temperature - 65° C. |
| Initial brightness 47.1 |

FIG. 1

Effect of particle size on CCS pulp - Particle size vs brightness at different times.

FIG. 2

Sample number vs final final brightness.

TABLE 5-continued

| Bleaching conditions |
|---|

FIG. 3

Effect of surface area on CCS pulp - Surface area vs brightness at different

FIG. 4

Effect of surface area on CCS pulp - Time vs brightness for different surface areas

What is claimed is:

1. A process for peroxide bleaching of pulp comprising the steps of:

adding magnesium oxide and hydrogen peroxide to said pulp, said magnesium oxide is utilized as MgO particles having a particle size of 5–500 microns and a particle surface area (PSA) of between 20–60 $m^2/g$; and bleaching said pulp for a period of 60–180 minutes to achieve a pulp ISO brightness of 55–65.

2. The process as claimed in claim 1 wherein said MgO particles have a particle size of less than 75 microns.

3. The process as claimed in claim 1 wherein the MgO particles have a particle size surface area of between 30–50 $m^2/g$.

4. The process as claimed in claim 1 which utilizes a dosage of MgO which is 0.3–2% based on the weight of the pulp.

5. The process as claimed in claim 1 wherein the amount of hydrogen peroxide utilized comprises 1–5% based on the weight of the pulp.

6. The process as claimed in claim 1 wherein the MgO particles are added to the pulp in the form of powder or slurry prepared in situ.

7. The process as claimed in claim 1 wherein the MgO particles are added to the pulp simultaneously with the addition of peroxide.

8. The process as claimed in claim 1 wherein the MgO particles is added to the pulp prior to the addition of peroxide.

9. process as claimed in claim 1 further comprising the step of adding:

a chelating agent to the pulp selected from DTPA, EDTA or HEDTA before said bleaching step.

10. The process as claimed in claim 9 wherein the chelating agent is added to the pulp simultaneously with the addition of MgO particles.

11. The process as claimed in claim 9 wherein the chelating agent is added to the pulp prior to the addition of MgO particles.

* * * * *